US009478186B2

(12) United States Patent
Nakata et al.

(10) Patent No.: US 9,478,186 B2
(45) Date of Patent: Oct. 25, 2016

(54) DISPLAY DEVICE WITH IDLE PERIODS FOR DATA SIGNALS

(75) Inventors: Jun Nakata, Osaka (JP); Kohji Saitoh, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 484 days.

(21) Appl. No.: 13/881,244

(22) PCT Filed: Oct. 21, 2011

(86) PCT No.: PCT/JP2011/074359
§ 371 (c)(1),
(2), (4) Date: Apr. 24, 2013

(87) PCT Pub. No.: WO2012/057044
PCT Pub. Date: May 3, 2012

(65) Prior Publication Data

US 2013/0222359 A1 Aug. 29, 2013

(30) Foreign Application Priority Data

Oct. 28, 2010 (JP) ..... 2010-242698

(51) Int. Cl.
*G09G 3/36* (2006.01)

(52) U.S. Cl.
CPC ..... *G09G 3/3674* (2013.01); *G09G 3/3614* (2013.01); *G09G 3/3648* (2013.01); *G09G 2310/08* (2013.01); *G09G 2330/021* (2013.01)

(58) Field of Classification Search
CPC . G09G 3/3688; G09G 3/3674; G09G 3/3614
USPC ..... 345/96
See application file for complete search history.

(56) References Cited

U.S. PATENT DOCUMENTS

2002/0063674 A1* 5/2002 Chiang ..... 345/98
2002/0080131 A1* 6/2002 Fujino ..... 345/208
2002/0093473 A1* 7/2002 Tanaka ..... G09G 3/3648 345/87
2002/0180673 A1* 12/2002 Tsuda ..... G09G 3/3648 345/87
2002/0180720 A1* 12/2002 Ishiyama ..... 345/208
2002/0190973 A1* 12/2002 Morita ..... 345/204
2003/0112212 A1* 6/2003 Speirs ..... 345/95
2004/0036669 A1* 2/2004 Yanagi ..... G09G 3/3648 345/98

(Continued)

FOREIGN PATENT DOCUMENTS

JP 11-296148 A 10/1999
JP 2002-182619 A 6/2002

(Continued)

*Primary Examiner* — Adam J Snyder
(74) *Attorney, Agent, or Firm* — Chen Yoshimura LLP

(57) ABSTRACT

When an idle period is started, a voltage of the control signal is changed from a value H to a value L. As a result, the analog amplifiers provided in the signal line driver circuit are switched from the normal state to the low-driving power state. At this time, the data signal lines are set to have a constant potential. A gate voltage is changed from Vgh to Vgl at the same time as when the control signal was changed from the value H to the value L. As a result, the gate of each TFT returns to the OFF state from the ON state. The control signal remains at the value L until the idle period is over. In other words, when the next driving period is started, the voltage of the control signal is changed from the value L to the value H. As a result, the analog amplifiers in the signal line driver circuit are switched back to the normal state from the low-driving power state.

7 Claims, 6 Drawing Sheets

(56) References Cited

U.S. PATENT DOCUMENTS

| | | | | |
|---|---|---|---|---|
| 2004/0113879 | A1* | 6/2004 | Sekiguchi | G09G 3/3648 345/94 |
| 2006/0227092 | A1* | 10/2006 | Nose | 345/98 |
| 2007/0001978 | A1* | 1/2007 | Cho | 345/98 |
| 2007/0018939 | A1* | 1/2007 | Chen et al. | 345/100 |
| 2007/0046614 | A1* | 3/2007 | Chien | 345/100 |
| 2008/0218500 | A1* | 9/2008 | Akai et al. | 345/205 |
| 2008/0224992 | A1* | 9/2008 | Kim et al. | 345/107 |
| 2009/0009452 | A1* | 1/2009 | Sunohara | 345/87 |
| 2012/0032935 | A1* | 2/2012 | Yen | 345/204 |

FOREIGN PATENT DOCUMENTS

| | | | |
|---|---|---|---|
| JP | 2004-206075 | A | 7/2004 |
| JP | 2006-53349 | A | 2/2006 |

* cited by examiner

DISPLAY DEVICE WITH IDLE PERIODS FOR DATA SIGNALS

TECHNICAL FIELD

The present invention relates to a display device that performs display by a dot inversion driving method, a display method for the same, and a liquid crystal display device.

BACKGROUND ART

In recent years, liquid crystal display devices are rapidly spreading, replacing cathode ray tubes (CRTs). The liquid crystal display devices have advantages of low energy consumption, thin profile, light weight, and the like, and are widely used as display panels for television receivers, personal computers, mobile phones, and the like.

In driving a liquid crystal display device, if a direct current voltage (DC voltage) is applied to liquid crystal molecules over a long period of time, characteristics thereof are deteriorated. Therefore, in order to avoid this problem, a polarity inversion driving method is generally employed such that the polarity of a voltage applied to the liquid crystal molecules is periodically reversed. One of the conventional polarity inversion driving methods is a line inversion driving method. In this method, the polarity of the voltage that is applied to the liquid crystal is reversed for respective adjacent bus lines. That is, in the first frame, all of the pixels on odd-numbered bus lines are applied with a positive polarity voltage, and all of the pixels on even-numbered bus lines are applied with a negative polarity voltage. Thereafter, in the second frame, all of the pixels on the odd-numbered bus lines are applied with a negative polarity data voltage, and all of the pixels on the even-numbered bus lines are applied with a positive polarity data voltage.

Recently, a driving method for a display device that can achieve a reduction in power consumption has been disclosed. With this method, by having an idle period in which all scanning signal lines are in a non-scanning state, the power consumption for driving a liquid crystal display device is reduced. For example, Patent Document 1 discloses a configuration of a display device that has a writing/scanning period and a non-writing/scanning period (idle period). In the writing/scanning period, the display portion is applied with voltages by line-scanning, and data writing is performed, and in the non-writing/scanning period (idle period), data is not written. In this configuration, the display device operates in a normal operation mode during the writing/scanning period, and operates in a power saving operation mode that uses less power than the normal operation mode during at least part of the non-writing/scanning period.

When the driving method with the idle period is combined with the above-mentioned line inversion driving method, if no source voltage is outputted from the data signal lines, flickering would occur. This is because a change in brightness is caused by a parasitic capacitance Csd between each data signal line and each drain electrode when the driving period and the idle period are switched over to each other.

In order to solve this problem, when the driving method with the idle period is combined with the line inversion driving method, the frequency of the source voltage during the idle period was set low. FIG. 6 shows waveforms of various signals in this case.

As shown in FIG. 6, during the normal driving period, the frequency of the output of the source voltage is set to high, and during the idle period, the frequency of the output of the source voltage is set to low. As a result, while source voltages are outputted during the idle period, because the frequency thereof is set to low, a reduction in power consumption can be achieved, and it is also possible to prevent the degradation in display quality caused by flickering.

RELATED ART DOCUMENT

Patent Document

Patent Document 1: Japanese Patent Application Laid-Open Publication, "Japanese Patent Application Laid-Open Publication No. 2006-53349 (Published on Feb. 23, 2006)"

SUMMARY OF THE INVENTION

Problems to be Solved by the Invention

When the driving method in which the frequency of the source voltage is set low during the idle period is combined with a dot inversion driving method, the above-mentioned problem of flickering would occur. This is because, as mentioned above, a change in brightness is caused by a parasitic capacitance Csd between each data signal line and each drain electrode when the driving period and the idle period are switched over to each other. Also, because the source voltages are outputted during the idle period, it is not possible to sufficiently reduce power consumption in driving the liquid crystal display device.

As described above, when the dot inversion driving method is combined with the above-mentioned driving method, it is not possible to achieve both a sufficient reduction in power consumption and high-quality display without flickering. This problem occurs not only in a liquid crystal display device, but also in any matrix type display device.

The present invention was made in view of the above-mentioned problems, and an object thereof is to provide a matrix type display device that can achieve both a sufficient reduction in power consumption and high-quality display in which flickering is sufficiently mitigated, a display method thereof, and a liquid crystal display device.

Means for Solving the Problems

In order to achieve the above-mentioned object, a display device according to one embodiment of the present invention is a display device that performs display with a dot inversion driving method, including a screen that has a plurality of scanning signal lines and a plurality of data signal lines arranged in a matrix and pixels provided for respective intersections thereof; a signal line driver circuit that drives each of the plurality of data signal lines; and a driving power control unit that controls a driving power of the signal line driver circuit, wherein an image is displayed by performing a scan to select each of the scanning signal lines and supplying data signals from the data signal lines to the pixels on a selected scanning signal line, wherein an idle period in which the plurality of data signal lines are set to have a constant potential is provided during a prescribed period of time between a driving period in which all of the scanning signal lines are scanned and a next driving period, and wherein, during the idle period, the driving power control unit lowers a driving power of the signal line driver circuit.

With this configuration, during the idle period, the driving power of the signal line driver circuit is kept low, and as a result, a constant current that flows through the signal line driver circuit can be reduced. Therefore, the average current consumption of the signal line driver circuit is made smaller than that of the conventional signal line driver circuit. Thus, with the display device according to one embodiment of the present invention, power consumption can be reduced as compared with a conventional display device.

The data signal lines are set to have a constant potential during the idle period such that the potential change in the data signal lines is made smaller when the idle period and the driving period are switched over to each other. This makes it possible to prevent a potential change in pixels caused by the potential change in the data signal lines, and as a result, a difference in brightness caused by a difference in size of the pixel potential change does not occur, which can prevent flickering.

As described above, with the display device according to one embodiment of the present invention, it is possible to achieve both a sufficient reduction in power consumption and high quality display in which flickering is sufficiently mitigated.

In order to achieve the above-mentioned object, a display method according to one embodiment of the present invention is a display method of a display device that displays an image by a dot inversion driving method, the display device including a screen having a plurality of scanning signal lines and a plurality of data signal lines arranged in a matrix and pixels provided for respective intersections thereof, the display device displaying an image by performing a scan to select each of the plurality of scanning signal lines, and providing data signals from the data signal lines to the pixels on a selected scanning signal line, the method including: a driving step of scanning all of the plurality of scanning signal lines; and an idle step of setting the plurality of data signal lines so as to have a constant potential, the idle step being provided during a prescribed period of time between the driving step and a next driving step, wherein, in the idle step, a driving power of a circuit that drives each of the data signal lines is lowered.

With this method, it is possible to provide a display method that can achieve both a sufficient reduction in power consumption and high quality display in which flickering is sufficiently mitigated.

Additional objects, features, and effects of the present invention shall be readily understood from the descriptions that follow. Advantages of the present invention shall become apparent by the following descriptions with reference to the appended drawings.

EFFECTS OF THE INVENTION

In the display device according to one embodiment of the present invention, during the idle period, the driving power of the signal line driver circuit is kept low, and as a result, a constant current that flows through the signal line driver circuit can be reduced. Also, in the display device according to one embodiment of the present invention, the data signal lines are set to have a constant potential during the idle period such that the potential change in the data signal lines is made smaller when the idle period and the driving period are switched over to each other. This makes it possible to prevent a potential change in pixels caused by the potential change in the data signal lines, and as a result, a difference in brightness caused by a difference in size of the pixel potential change does not occur, which can prevent flickering. Thus, with the display device according to one embodiment of the present invention, it is possible to achieve both a sufficient reduction in power consumption and high quality display in which flickering is sufficiently mitigated.

DETAILED DESCRIPTION OF EMBODIMENTS

Below, embodiments of a display device according to the present invention will be explained in details with reference to figures.

(Configuration of Display Device 1)

Figure 2:
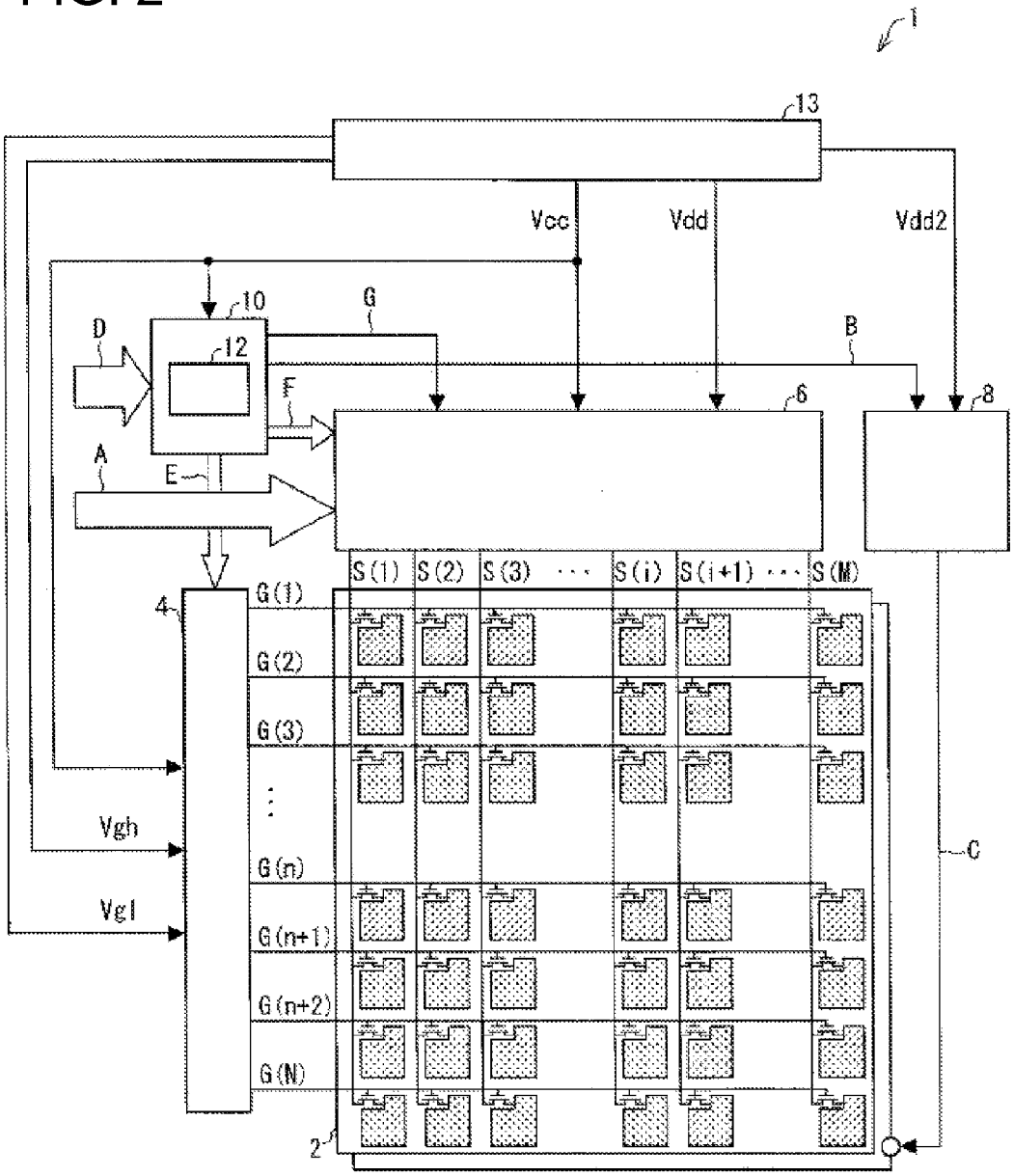
FIG. 2 is a diagram showing an overall configuration of a display device according to one embodiment of the present invention.

First, a configuration of a display device 1 (liquid crystal display device) of the present embodiment will be explained with reference to FIG. 2. FIG. 2 is a diagram showing an overall configuration of the display device 1. As shown in the figure, the display device 1 includes a display panel 2, a scanning line driver circuit (gate driver) 4, a signal line driver circuit (source driver) 6, a common electrode driver circuit 8, a timing controller 10, and a power generation circuit 13. The timing controller 10 includes a control signal output part (driving power control unit) 12. The display device 1 is a matrix type display device that is driven by a dot inversion driving method.

The display panel 2 includes a screen that has a plurality of pixels arranged in a matrix, N (N is an integer) number of scanning signal lines G (gate lines) for scanning the screen in a line-sequential manner, and M (M is an integer) number of data signal lines S (source lines) for providing data signals to pixels on respective selected lines. The scanning signal lines G and the data signal lines S are arranged so as to intersect with each other, and pixels are provided for the respective intersections. That is, a region enclosed by two adjacent scanning signal lines G and two adjacent data signal lines S is one pixel.

G(n) in FIG. 2 represents the n-th (n is an integer) scanning signal line G. For example, G(1), G(2), and G(3) respectively represent the first, second, and third scanning signal lines G. On the other hand, S(i) represents the i-th (i is an integer) data signal line S. For example, S(1), S(2), and S(3) respectively represent the first, second, and third data signal lines S.

The scanning line driver circuit 4 scans the respective scanning signal lines G from the top to bottom of the screen in a line-sequential manner. During the scan, the scanning line driver circuit 4 outputs to each scanning signal line G a square wave to turn on switching elements (TFTs) provided for respective pixels and connected to respective pixel electrodes. This way, pixels on each line in the screen are set to a selected state.

The signal line driver circuit 6 calculates, based on a received image signal (the arrow A), values of voltages to be applied to the selected pixels for one line, and outputs the voltages to the respective data signal lines S. As a result, image data is supplied to the respective pixels on the selected scanning signal line G.

The display device 1 includes a common electrode (not shown) disposed to face the respective pixels in the screen. The common electrode driver circuit 8 outputs to the common electrode a prescribed common voltage for driving the common electrode, based on a signal (the arrow B) sent from the timing controller 10.

The timing controller 10 outputs reference signals to the respective circuits such that the respective circuits operate in a synchronized manner, based on received horizontal synchronization signal Hsync and vertical synchronization signal Vsync (the allow D). Specifically, the timing controller 10 outputs a gate start pulse signal and a gate clock signal to the scanning line driver circuit 4 (the arrow E), and outputs a source start pulse signal, a source latch strobe signal, and a source clock signal to the signal line driver circuit 6 (the arrow F).

Upon receipt of the gate start pulse signal from the timing controller 10, the scanning line driver circuit 4 starts scanning the display panel 2, and applies a select voltage to the respective scanning signal lines G sequentially, based on the gate clock signal. Upon receipt of the source start pulse signal from the timing controller 10, the signal line driver circuit 6 stores the received image data for each pixel in a register according to the source clock signal, and writes the image data into the respective data signal lines S in the display panel 2 according to the subsequent source latch strobe signal.

The power generation circuit 13 generates voltages Vdd, Vdd2, Vcc, Vgh, and Vgl that are necessary to operate the respective circuits in the display device 1. Vcc, Vgh, and Vgl are outputted to the scanning line driver circuit 4, Vdd and Vcc are outputted to the signal line driver circuit 6, Vcc is outputted to the timing controller 10, and Vdd2 is outputted to the common electrode driver circuit 8.

(Driving Period and Idle period)

Figure 3:
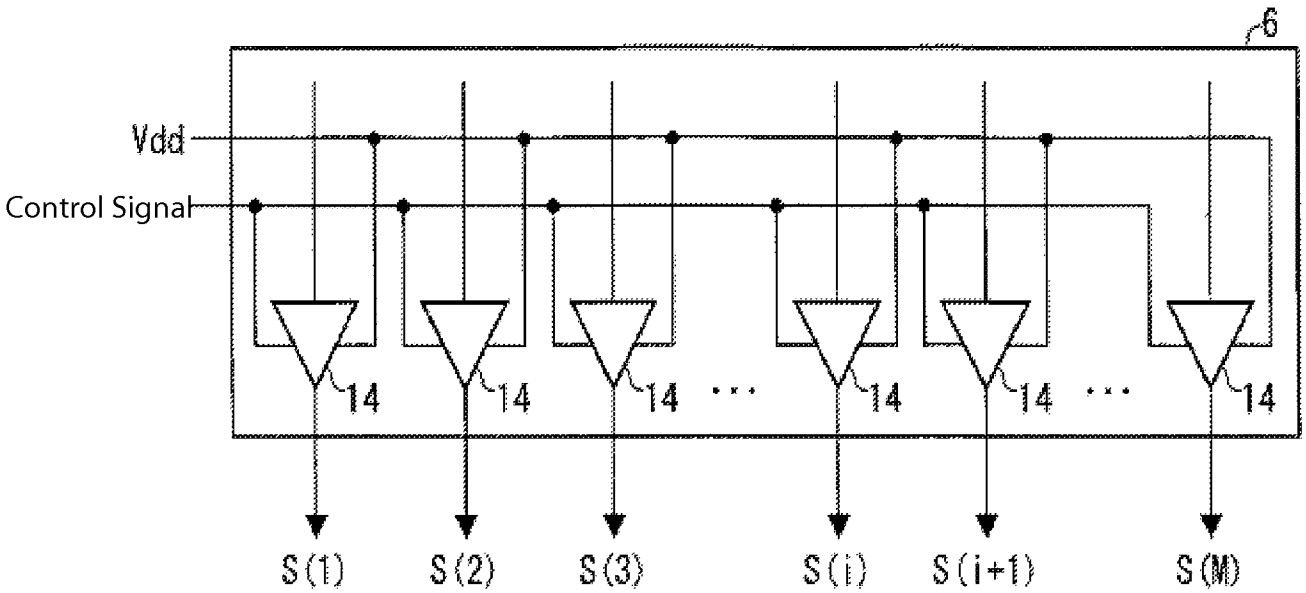
FIG. 3 is a diagram showing an internal configuration, particularly, an output portion of a signal line driver circuit according to one embodiment of the present invention.

Driving of the display device 1 according to the present embodiment will be explained in detail with reference to FIG. 3. FIG. 3 is a diagram showing an internal configuration, particularly, an output portion of the signal line driver circuit 6.

As shown in FIG. 3, the signal line driver circuit 6 is provided with a plurality of analog amplifiers 14. The analog amplifiers 14 are provided for the respective data signal lines S. Therefore, the signal line driver circuit 6 of the present embodiment is provided with M number of analog amplifiers 14. That is, the number of the analog amplifiers 14 and the number of the data signal lines S are the same.

The signal line driver circuit 6 further includes control signal lines for inputting control signals (the arrow G of FIG. 2) to the respective analog amplifier 14. The respective control signal lines are connected to the control signal output part 12 of the timing controller 10. Also, in the signal line driver circuit 6, the respective control signal lines are connected to the respective analog amplifiers 14 in parallel with each other.

As described above, Vdd is a power source supplied from the power generation circuit 13 in the display device 1, and is used to operate the respective circuits in the display device 1 including the signal line driver circuit 6. The analog amplifiers 14 are also operated by receiving Vdd.

The control signal output part 12 of the timing controller 10 outputs a control signal that defines a power (driving power) of each analog amplifier 14 to each analog amplifier 14 of the signal line driver circuit 6 at a prescribed timing. Specifically, the control signal output part 12 raises the voltage of the control signal to a value H (high level) upon receipt of a vertical synchronization signal Vsync or at a prescribed timing, and thereafter sets the voltage of the control signal to a value L (low level) upon receipt of the next vertical synchronization signal Vsync or at a prescribed timing. When the control signal is set to the value H, the analog amplifier 14 is in a normal state, and operates with a normal driving power. When the control signal is set to the value L, the analog amplifier 14 is in a low-driving power state, and operates with a lower driving power.

In driving the display panel 2, the display device 1 repeats a driving period that lasts for a prescribed period of time and an idle period that lasts for a prescribed period of time. During the driving period, the control signal is set to the value H such that the analog amplifiers 14 are operated in a normal state, and the scanning signal is set to Vgh to turn the gates of the TFTs on. That is, the driving period is a scanning period in which voltages necessary for display are written into the pixel electrodes. In the present embodiment, the driving period lasts for one vertical period.

On the other hand, during the idle period, the control signal is set to the value L such that the analog amplifiers 14 are operated in the lower driving power state, and the scanning signal is set to Vgl to turn the gates of the TFTs off. That is, the idle period is a non-scanning period in which writing to the pixel electrodes is not performed. In the present embodiment, the idle period lasts for two vertical periods subsequent to the driving period.

(Signal Waveform)

Figure 1:
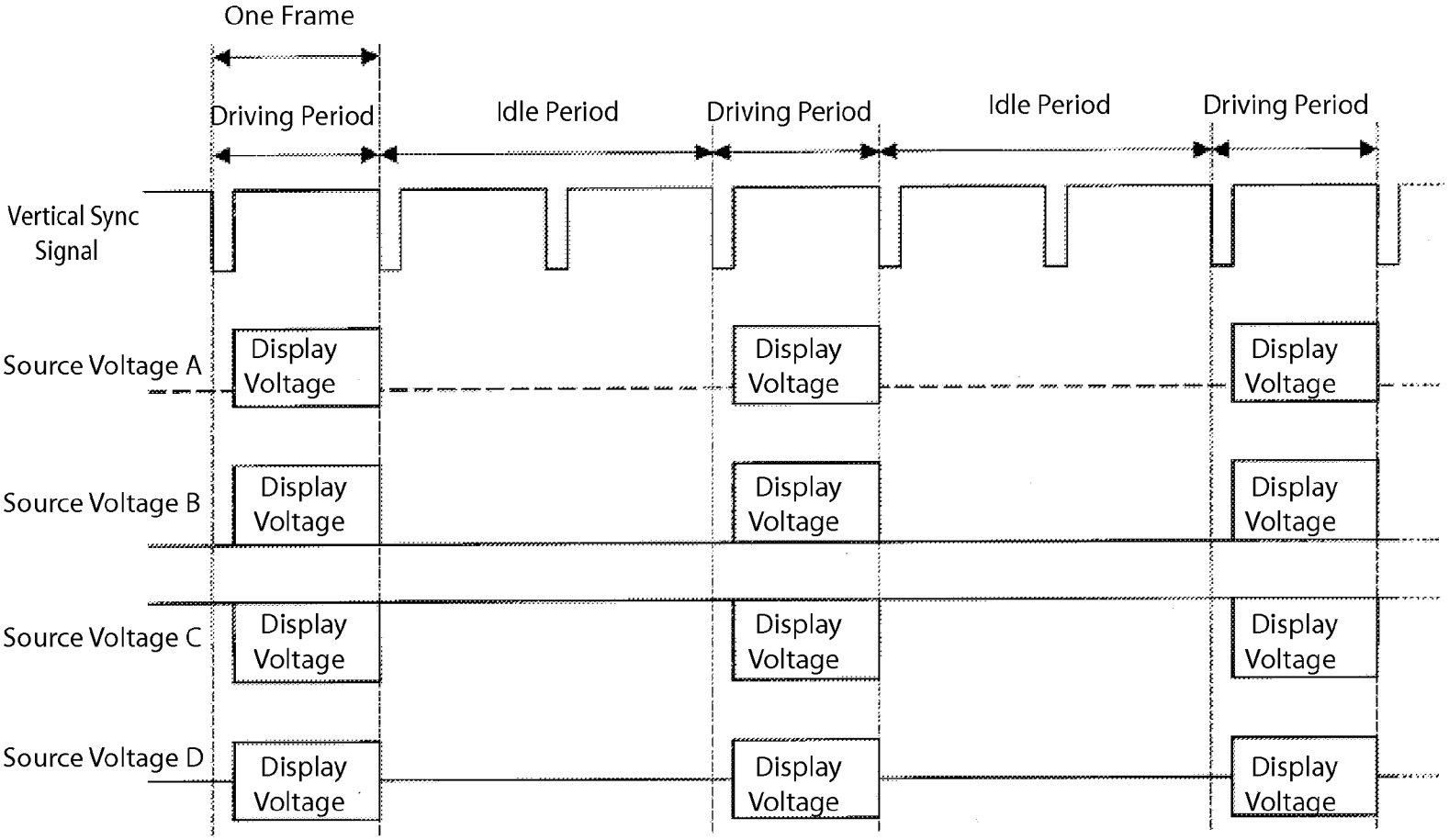
FIG. 1 is a diagram showing waveforms of various signals in driving a display panel of a display device according to one embodiment of the present invention.

Waveforms of various signals used to drive the display panel will be explained in detail. FIG. 1 is a diagram showing waveforms of various signals in driving the display panel 2 of the display device 1 according to one embodiment of the present invention.

As shown in FIG. 1, in the display device 1, Vsync is inputted in every vertical period. In synchronization with Vsync, first, the voltage of the control signal is changed from the value L to the value H. As a result, the analog amplifiers 14 provided in the signal line driver circuit 6 are switched from the low driving power state to the normal state. The control signal remains at the value H until all of the scanning signal lines G are scanned.

Next, in synchronization with Vsync, a voltage applied to the first scanning signal line G(1) is changed from Vgl (the value L) to Vgh (the value H). This turns on the gates of the TFTs in the pixels connected to the scanning signal line G(1).

Next, in synchronization with Vsync, a data signal is outputted to each data signal line S from the analog amplifier 14 connected to that data signal line S(i). As a result, voltages necessary for display (display voltages) are supplied to the respective data signal lines S, and are written into the pixel electrodes via TFTs. The display device 1 drives the display panel 2 in a dot inversion manner, and therefore, every time pixels to be selected are changed, the polarity of the voltages applied to the data signal lines S is inversed. For example, in FIG. 2, when the first scanning signal line G(1) is selected, the first data signal line S(1) is applied with a data signal that changes from negative to positive, and the second data signal line S(2) is applied with a data signal that changes from positive to negative.

After the voltages necessary for display are applied, display voltages are outputted to the pixels connected to the second scanning signal line G(2). The pixels connected to each scanning signal line G subsequent to the first scanning signal line are supplied with display voltages in a manner similar to the pixels connected to the first scanning signal line G(1).

After scanning the entire scanning signal lines G, the driving period is completed. That is, one vertical period is completed. When the first vertical period is ended, next V sync is inputted, and in synchronization with Vsync, the voltage of the control signal is changed from the value H to the value L. As a result, the analog amplifiers 14 provided in the signal line driver circuit 6 are switched from the normal state to the low-driving power state. At this time, as described in detail below, each data signal line S(i) is set so as to have a constant potential. This does not largely affect display, because the voltages necessary for display have already been applied to the pixel electrodes.

When the control signal is changed from the value H to the value L, the gate voltage is changed from Vgh to Vgl. As a result, the gate of each TFT returns to the OFF state from the ON state. The control signal remains at the value L until the idle period is over. That is, after two vertical periods have passed, the voltage of the control signal is changed from the value L to the value H in synchronization with Vsync. As a result, the analog amplifiers 14 in the signal line driver circuit 6 are switched back to the normal state from the low-driving power state.

(Data Signal Lines during Idle Period)

During the idle period, the potential of each data signal line S(i) is kept constant. During this period, a voltage outputted from the signal line driver circuit 6 is one of source voltages A to D shown in FIG. 1, for example.

Specifically, in the source voltage A, after all scanning signal lines G are scanned (display voltages are supplied) in the driving period, the idle period starts, and the output from the signal line driver circuit 6 is set to a high-impedance (Hi-Z) state. This creates a floating state of the potential of each data signal line S(i), and therefore, the potential of each data signal line S(i) does not change. In this case, during the idle period, the data signal lines are not driven, and the data signals are not supplied to the respective pixels that constitute the display panel 2. That is, during this period, image data is not written into each pixel, and therefore, even though the output of the signal line driver circuit 6 is in a high-impedance state, image display is not affected.

In the source voltage B, after all scanning signal lines G are scanned (display voltages are supplied) in the driving period, the idle period starts, and the output of the signal line driver circuit 6 is set to a ground (GND) potential. This makes the potential of each data signal line S(i) a GND potential, and therefore, the potential of each data signal line S(i) does not change. In this case, during the idle period, image data is not written into each pixel, and therefore, even though the output of the signal line driver circuit 6 is set to a GND potential, image display is not affected.

In the source voltage C, after all scanning signal lines G are scanned (display voltage application) in the driving period, the idle period starts, and the output of the signal line driver circuit 6 is set to a high voltage. The high voltage is a voltage that has the largest difference from a ground potential between a voltage outputted to each data signal line S(i) when displaying the lowest gradation level and a voltage outputted to each data signal line S(i) when displaying the highest gradation level. For example, if the display device 1 is an 8-bit normally black mode device, and when the output voltage (positive polarity) for displaying the 0 gradation level is 1.0V, and the output voltage (positive polarity) for displaying the 255 gradation level is 5.0V, the high voltage is 5.0V. If the display device 1 is a 6-bit normally white mode device, and when the output voltage (positive polarity) for displaying the 0 gradation level is 4.0V, and the output voltage (positive polarity) for displaying the 64 gradation level is 1.0V, the high voltage is 4.0V. In this way, the potential of each data signal line S(i) is set to the high voltage, and therefore, the potential of the data signal line S(i) does not change. In this case, during the idle period, image data is not written into each pixel, and therefore, even though the output of the signal line driver circuit 6 is set to a high voltage, image display is not affected.

On the other hand, in the source voltage D, after all scanning signal lines G are scanned (display voltages are supplied) in the driving period, the idle period starts, and the output of the signal line driver circuit 6 is set to the voltage that was outputted at the last scanning signal line G(N). As a result, the potential of each data signal line S(i) is set to the potential that was outputted to the data signal line S(i) at the last scanning signal line G(N), and therefore, the potential of the data signal line S(i) does not change. In this case, during the idle period, image data is not written into each pixel, and therefore, even though the output of the signal line driver circuit 6 is set to the voltage that was outputted at the last scanning signal line G(N), image display is not affected.

As described above, by keeping the potential of each data signal line S(i) constant during the idle period, an occurrence of flickering can be mitigated. The reason will be explained below.

Figure 4:
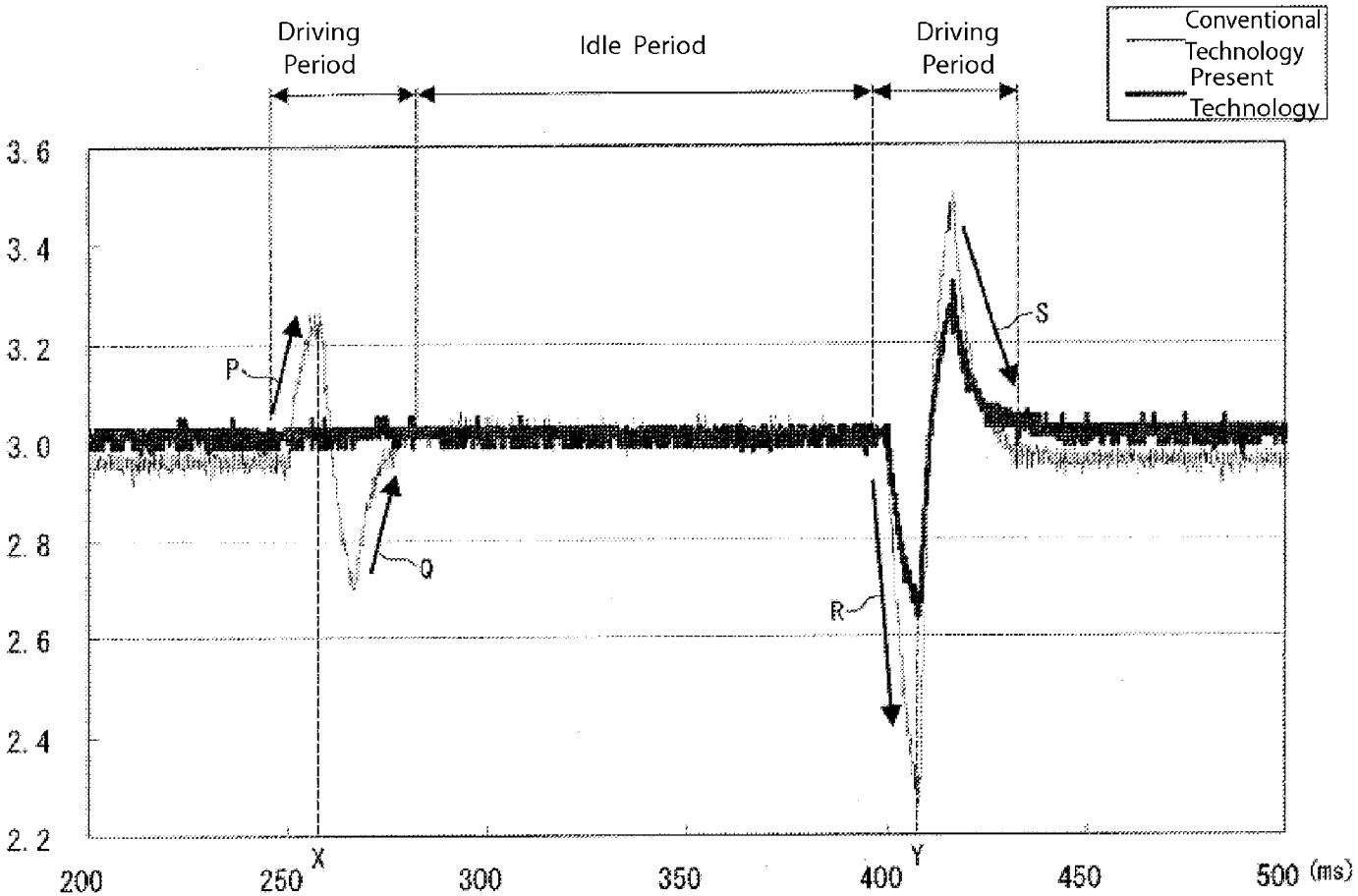
FIG. 4 is a diagram showing changes in brightness in driving a display device of one embodiment of the present invention and changes in brightness in driving a conventional display device.

FIG. 4 is a diagram showing changes in brightness when driving a display device 1 of the present embodiment and changes in brightness when driving a conventional display device. In this figure, the vertical axis represents a relative brightness, and the horizontal axis represents time. In this figure, the pixels are applied with a positive polarity voltage at the point X (positive polarity writing), and the pixels are applied with a negative polarity voltage at the point Y (negative polarity writing). The conventional display device is driven by a conventional dot inversion driving method that does not have an idle period.

As shown in FIG. 4, in the conventional display device, when the positive polarity writing is performed (point X), the brightness is changed. This is because a source-drain parasitic capacitance (Csd) is formed in an overlapping area of a pixel electrode and a data signal line, and through this capacitance, the potential of the pixel is affected by the potential change in the data signal line (the arrows P and Q in the figure). Because the changes due to the respective data signal lines are not necessarily the same throughout the screen, the differences in size of potential change in the respective pixels are shown as differences in brightness among the respective horizontal lines (that is, flickering), and as a result, a uniform display cannot be achieved.

Similarly, when the negative polarity writing is performed (point Y), the potential of each pixel is changed by the potential change in a data signal line (the arrows R and S in the figure). As a result, the differences in size of potential change in the respective pixels are shown as differences in brightness among the respective horizontal lines.

In contrast, in the display device 1 of the present embodiment, as shown in FIG. 4, the brightness does not change almost at all in the positive polarity writing, and the brightness change in the negative polarity writing is smaller than that in the conventional display device. This is because the potential of each data signal line S(i) is kept constant during the idle period, thereby reducing the size of the potential change in the data signal line S(i) when the idle period and the driving period are switched over to each other. This makes it possible to reduce a change in the potential in each pixel caused by a potential change in a data signal line S(i). As a result, the difference in brightness is not caused by the difference in size of potential change among pixels, which makes it possible to prevent flickering.

(Power Consumption in Display Device 1)

The problem of power consumption in a conventional display device will be explained. A display device having a typical resolution WSVGA (1024RGB×600) will be explained as an example. This display device requires 3072 (1024×3 (RGB)) analog amplifiers in a signal line driver circuit. The respective analog amplifiers are elements that output data signals to the data signal lines. Each analog amplifier is applied with a constant current of about 0.01 mA to ensure the output power.

Therefore, the total constant current in the 3072 analog amplifiers is about 30.7 mA. The signal line driver circuit is generally supplied with a power (Vdd) of about 10V, and therefore, power consumption of the signal line driver circuit is 10V×30.7 mA=307 mA. This value accounts for a large part of power consumption of the entire display device, and is one of the major factors that hinder a reduction in power consumption of the display device.

On the other hand, the display device 1 of the present embodiment can be operated with less power than the conventional display device. The reason will be explained below.

In the display device 1, the potential of each data signal line S(i) is kept constant during the idle period. When the potential of each data signal line S(i) is kept constant, an analog amplifier 14 only needs a smaller current to keep the potential of the data signal line S(i) constant. Therefore, it is possible to reduce a current that the analog amplifier 14 supplies to the data signal line S(i). As a result, even when the analog amplifier 14 connected to the data signal line S(i) is set to the low-driving power state, voltage supply to the data signal line S(i) can be done without any problem.

This allows the driving power of the analog amplifiers 14 to be reduced during the idle period, and therefore, it is possible to reduce the power consumption in the signal line driver circuit 6. As a result, a reduction in power consumption in the display device 1 is achieved.

Also, as described above, in the display device 1 of the present embodiment, the potential of each data signal line S(i) is kept constant during the idle period, which makes it possible to prevent the occurrence of flickering. Thus, with the display device 1 according to the present embodiment, it is possible to achieve both a sufficient reduction in power consumption and high quality display in which flickering is sufficiently mitigated.

(Configuration with Gradation Amplifier)

In the present embodiment, the number of the analog amplifiers 14 and the number of the data signal lines S do not have to be the same. For example, when configured such that the analog amplifiers 14 are provide for respective gradation levels, the number thereof can be made smaller than that of the data signal lines S. This example will be explained below.

In this example, the signal line driver circuit 6 of the display device 1 is provided with 256 analog amplifiers (gradation levels) 14. Each analog amplifier 14 outputs one of V0 to V255, which are voltages to display respective gradation levels of 0 to 255, to a data signal line S(i). The voltage to be outputted is fixed to each analog amplifier 14, and there is only one analog amplifier 14 that outputs the same voltage.

The output of each analog amplifier 14 can be connected to all of the data signal lines S in the display panel 2. Thus, it is possible to output the same voltage from one analog amplifier 14 to an appropriate number of data signal lines S. When driving the display panel 2, each data signal line S(i) connected to a pixel on the selected scanning signal line G is connected to an analog amplifier 14 that outputs a voltage corresponding to a gradation level to be displayed in that pixel.

Each analog amplifier 14 can receive the above-mentioned control signal. Therefore, the driving method explained with reference to FIG. 1 can be performed. That is, during the idle period, which lasts for two vertical periods, all of 256 analog amplifiers 14 are set to the low-driving power state. This makes it possible to reduce a constant current during the idle period, and as a result, the power consumption can be reduced.

(Additional Notes)

The present invention is not limited to the above-mentioned embodiment, and various modifications can be made without departing from the scope of the claims. That is, embodiments obtained by combining techniques modified without departing from the scope of the claims are also included in the technical scope of the present invention.

During the idle period, if at least one of the analog amplifiers 14 in the signal line driver circuit 6 is set to the low-driving power state, an effect of reducing power consumption can be obtained while making possible a video display. It is preferable to set all of the analog amplifiers 14 to the low-driving power state to obtain maximum effect in reducing the power consumption.

However, when a video is displayed on the entire screen, setting some of the analog amplifiers 14 to the low-driving power state possibly causes an image to crash due to weak battery. In this case, it is preferable to determine analog amplifiers 14 to be set to the low-driving power state so as not to affect the video display. Even in this case, the power consumption can be sufficiently reduced.

When the video display is performed only in a part of the entire screen, it is preferable that analog amplifiers 14 in a region where a still image is displayed be set to the low-driving power state, and analog amplifiers 14 in a region where a video is displayed be set to the normal state. This way, the power consumption can be reduced as a whole.

The end of the driving period does not necessarily coincide with the end of a vertical period. The start of the idle period does not necessarily coincide with the start of a vertical period subsequent to the driving period. The end of the idle period does not necessarily coincide with the end of the two vertical periods subsequent to the driving period, and may occur prior to it. That is, the driving period and the idle period may be shorter than one vertical period, or may be longer than one vertical period.

Figure 5:
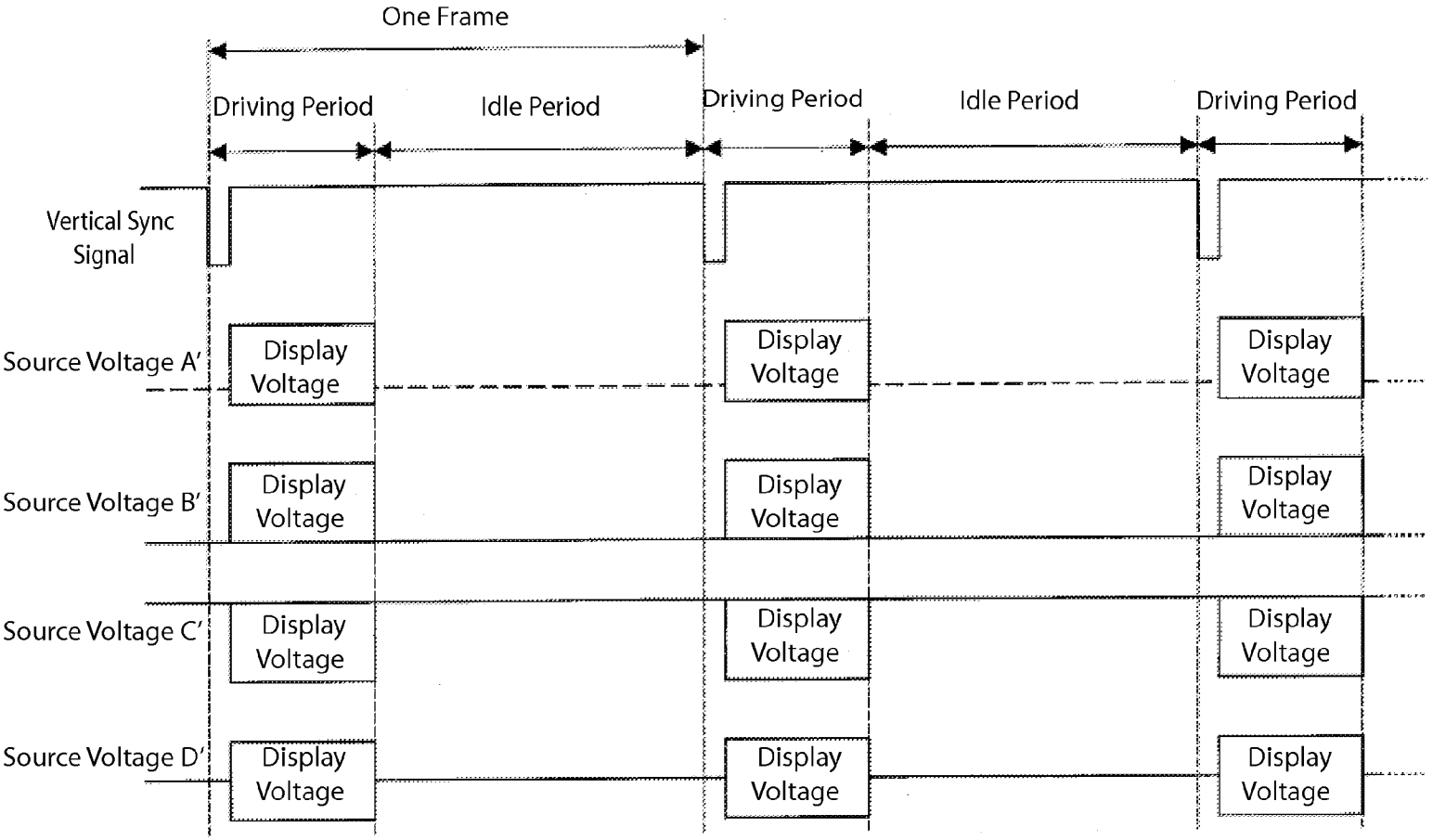
FIG. 5 is a diagram showing waveforms of various signals in driving a display panel of a display device according to another embodiment of the present invention.
Figure 6:
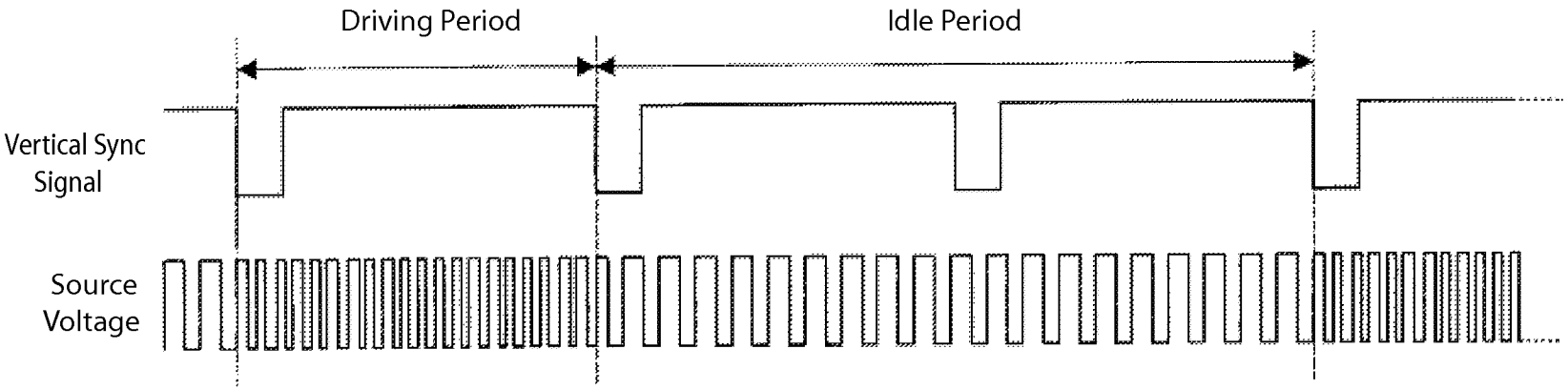
FIG. 6 is a diagram showing waveforms of various signals in a line inversion driving method that has an idle period.

For example, it is possible to have both the driving period and the idle period in one vertical period. That is, it is also possible to employ a configuration in which, in a vertical period, the driving period starts and ends, which is immediately followed by the idle period, and the idle period ends when the vertical period ends. This example will be explained with reference to FIG. 5. FIG. 5 is a diagram showing various signal waveforms in driving the display panel 2 of the display device 1 of another embodiment of the present invention.

When one vertical period is divided into the driving period and the idle period in driving the display panel 2, first, the voltage of the control signal is changed from the value H to the value L in synchronization with Vsync. As a result, the analog amplifiers 14 in the signal line driver circuit 6 are switched to the normal state from the low-driving power state. The control signal is maintained at the value H until all of the scanning signal lines G are scanned.

Next, in synchronization with Vsync, a voltage applied to the first scanning signal line G(1) is changed from Vgl (the value L) to Vgh (the value H). This turns on the gates of the TFTs in the pixels connected to the scanning signal line G(1).

Next, in synchronization with Vsync, each data signal line S is supplied with a data signal from an analog amplifier 14 that is connected to that data signal line S(i). As a result, voltages necessary for display (display voltages) are supplied to the respective data signal lines S, and are written into the pixel electrodes via TFTs. The display device 1 drives the display panel 2 in a dot inversion manner, and therefore, every time pixels to be selected are changed, the polarity of the voltages applied to the data signal lines S is inversed. For example, in FIG. 2, when the first scanning signal line G(1) is selected, the first data signal line S(1) is applied with a data signal that changes from negative to positive, and the second data signal line S(2) is applied with a data signal that changes from positive to negative.

After the voltages necessary for display are applied, display voltages are outputted to the pixels connected to the second scanning signal line G(2). The pixels connected to each scanning signal line G subsequent to the first scanning signal line are supplied with display voltages in a manner similar to the pixels connected to the first scanning signal line G(1).

After scanning all of the scanning signal lines G, the driving period is completed. Thereafter, the voltage of the control signal is changed from the value H to the value L. As a result, the analog amplifiers 14 provided in the signal line driver circuit 6 are switched from the normal state to the low-driving power state. Here, as in the above embodiment, the data signal lines S are set to have a constant potential. During this period, a voltage outputted from the signal line driver circuit 6 is one of source voltages A' to D' shown in FIG. 5, for example.

In the source voltage A', the output from the signal line driver circuit 6 is set to the high impedance state (Hi-Z) during the idle period, and in the source voltage B', the output from the signal line driver circuit 6 is set to a ground (GND) potential during the idle time. On the other hand, in the source voltage C', the output from the signal line driver circuit 6 is set to a high voltage during the idle time, and in the source voltage D', during the idle period, the output of the signal line driver circuit 6 is set to the voltage that was outputted at the last scanning signal line G(N). This does not largely affect the display, because the voltages necessary for display have already been applied to the pixel electrodes.

When the control signal is changed from the value H to the value L, the gate voltage is changed from Vgh to Vgl. As a result, the gate of each TFT returns to the OFF state from the ON state. The control signal remains at the value L until the idle period is over. When the first vertical period is completed, the next Vsync is inputted, and in synchronization with this Vsync, the voltage of the control signal is changed from the value L to the value H. As a result, the analog amplifiers 14 in the signal line driver circuit 6 are switched back to the normal state from the low-driving power state.

A period of time required for completing application of the voltages necessary for display, in other words, the driving period, mainly depends on the characteristics of TFTs. Therefore, the period of time can be calculated based on the design values and the like of the TFTs, and can be used by being stored in the display device 1. That is, the idle period, in other words the non-scanning period, can be a period having an appropriate length of time that occurs between the end of the driving period and the end of one horizontal synchronization period.

In the above-mentioned embodiment, the driving period lasts for one vertical period, and the idle period lasts for two vertical periods, which reduces the frequency of rewriting the screen per unit time. As a result, the refresh rate in each pixel is lowered. The lower refresh rate means a smaller number of images can be displayed in one second, and therefore, it is not possible to play a video smoothly. For example, generally, the refresh rate is set to 60 Hz, and 60 images are displayed per second. However, if the driving period and the idle period are set to last for one vertical period and two vertical periods, respectively, the refresh rate becomes one third of the normal refresh rate, which is 20 Hz. That is, because only 20 images can be displayed per second, some images in the video will not be displayed. If the driving period and the idle period are configured so as to occur within one vertical period, the idle period is ended within the vertical period. Specifically, in every vertical period, the analog amplifiers 14 are set to the normal state, and a voltage necessary for display is outputted to each data signal line S(i). As a result, the refresh period of each pixel becomes equal to one vertical period, and in other words, the image can be refreshed in every vertical period. Because the refresh rate of the images is not reduced, it is possible to play a video smoothly.

(Summary of Embodiments)

As described above, in a display device according to one embodiment of the present invention, the signal line driver circuit outputs the data signal to each of the data signal lines during the driving period, and during the idle period, the signal line driver circuit sets an output to the respective data signal lines to one of a high-impedance state, a ground potential, and a high voltage, such that the plurality of data signal lines have a constant potential.

In the display device according to one embodiment of the present invention, the signal line driver circuit outputs the data signal to each of the data signal lines during the driving period, and during the idle period, the signal line driver circuit outputs to each of the data signal lines the data signal that has a largest difference from a ground potential between the data signal outputted to each of the data signal lines when displaying a lowest gradation level and the data signal outputted to each of the data signal lines when displaying a highest gradation level, such that the plurality of data signal lines have a constant potential.

In the display device according to one embodiment of the present invention, the signal line driver circuit outputs the data signal to each of the data signal lines during the driving period, and during the idle period, the signal line driver circuit outputs to the respective data signal lines the data signal that was outputted to each of the data signal lines at a scanning signal line that was selected in the end of the driving period, such that the plurality of data signal lines have a constant potential.

With these configurations, the potential of the data signal lines does not change almost at all. This makes it possible to prevent an occurrence of flickering and to achieve high quality display without flickering.

In the display device according to one embodiment of the present invention, the signal line driver circuit includes a plurality of analog amplifiers that are provided for the respective data signal lines, and the driving power control unit lowers a driving power of at least one of the plurality of analog amplifiers.

In the display device according to one embodiment of the present invention, the driving power control unit lowers a driving power of all of the analog amplifiers.

With these configurations, it is possible to reduce a constant current flowing through the analog amplifiers during the idle period. Also, by lowering the driving power of all of the analog amplifiers, a reduction in power consumption can be maximized.

The display device according to one embodiment of the present invention further includes a scanning line driver circuit that outputs signals that turn on and off a gate of each of switching elements connected to respective pixel electrodes, and the scanning line driver circuit outputs a signal that turns off a gate of each of the switching elements at a start of the idle period.

With this configuration, during the idle period, the data signal lines are not driven, and data signals are not supplied to the respective pixels. That is, during this period, image data is not written into each pixel, and therefore, the state of the output of the signal line driver circuit does not affect image display.

In the display device according to one embodiment of the present invention, a start of the driving period coincides with a start of a vertical period, and a start of the idle period coincides with a start of another vertical period.

In the display device according to one embodiment of the present invention, the driving period starts at a same time as a start of a vertical period, and ends within the vertical period, and the idle period starts immediately after the driving period is completed, and ends at a same time as an end of the vertical period.

With this configuration, the driving period and the idle period may be shorter than one vertical period, or may be longer than one vertical period. When the driving period and the idle period are provided in one vertical period, the refresh rate in each pixel becomes equal to one vertical period, and in other words, an image is refreshed in every vertical period. As a result, the refresh rate of images is not reduced, and therefore, it is possible to play a video smoothly.

In the display device according to one embodiment of the present invention, when the idle period is completed, the driving power control unit returns the driving power of the signal line driver circuit to a normal driving power, and the scanning line driver circuit outputs a signal that turns on a gate of each of the switching elements.

With this configuration, when the next driving period is started, normal voltages can be applied to pixels.

The display device according to one embodiment of the present invention is a liquid crystal display device.

With this method, it is possible to provide a liquid crystal display device that can achieve both a sufficient reduction in power consumption and high quality display in which flickering is sufficiently mitigated.

Specific embodiments and examples provided in the Detailed Description of Embodiments are to merely illustrate the technical content of the present invention, and the present invention shall not be narrowly interpreted by being limited to such examples. Various modifications can be made without departing from the spirit of the present invention and the scope of the appended claims.

INDUSTRIAL APPLICABILITY

A display device according to the present invention can be widely used as various display device such that a liquid crystal display device, an organic EL display device, an electric paper.

DESCRIPTION OF REFERENCE CHARACTERS

1 display device
2 display panel
4 scanning line driver circuit
6 signal line driver circuit
8 common electrode driver circuit
10 timing controller
12 control signal output part
13 power generation circuit
14 analog amplifier
S data signal line
G scanning signal line

The invention claimed is:

1. A display device that performs display with a dot inversion driving method, comprising:

a screen having a plurality of scanning signal lines and a plurality of data signal lines arranged in a matrix and pixels provided for respective intersections thereof;

a signal line driver circuit that drives each of the data signal lines; and a driving power control unit that controls a driving power of the signal line driver circuit, wherein display is conducted by performing a scan to select each of the scanning signal lines and supplying data signals to the pixels on a selected scanning signal line from the data signal lines, and wherein, during a prescribed period of time between one driving period in which all of the scanning signal lines are scanned and a next driving period, an idle period is provided during which potentials of the plurality of data signal lines are kept constant, and during the idle period, the driving power control unit lowers a driving power of the signal line driver circuit, wherein the signal line driver circuit outputs the data signals to the respective data signal lines during the driving period, and during the idle period, the signal line driver circuit outputs to the respective data signal lines the data signal that was outputted to the respective data signal lines at a scanning signal line that was selected in the end of the driving period, such that the plurality of data signal lines have respective constant potentials.

2. The display device according to claim 1, wherein the signal line driver circuit includes a plurality of analog amplifiers provided for the respective data signal lines, and wherein the driving power control unit lowers a driving power of at least one of the plurality of analog amplifiers.

3. The display device according to claim 2, wherein the driving power control unit lowers a driving power of all of the analog amplifiers.

4. The display device according to claim 1, further comprising a scanning line driver circuit that outputs a signal that turns on or off a gate of each of switching elements connected to respective pixel electrodes, wherein the scanning line driver circuit outputs a signal that turns off a gate of each of the switching elements at a start of the idle period.

5. The display device according to claim 4, wherein at an end of the idle period, the driving power control unit returns a driving power of the signal line driver circuit to a normal driving power, and the scanning line driver circuit outputs a signal that turns on a gate of each of the switching elements.

6. The display device according to claim 1, wherein a start of the driving period coincides with a start of a vertical period, and wherein a start of the idle period coincides with a start of another vertical period.

7. The display device according to claim 1, wherein a start of the driving period coincides with a start of a vertical period, wherein the driving period is completed within the vertical period, wherein the idle period starts immediately after the driving period, and wherein an end of the idle period coincides with an end of the vertical period.

* * * * *